US008141275B1

(12) United States Patent
Donaldson et al.

(10) Patent No.: US 8,141,275 B1
(45) Date of Patent: Mar. 27, 2012

(54) HEEL SHEATH PROTECTIVE COVER FOR A SHOE

(76) Inventors: Frank W. Donaldson, Los Angeles, CA (US); Ann Hargress-Wagner, Los Angeles, CA (US)

( * ) Notice: Subject to any disclaimer, the term of this patent is extended or adjusted under 35 U.S.C. 154(b) by 538 days.

(21) Appl. No.: 12/332,645

(22) Filed: Dec. 11, 2008

(51) Int. Cl.
*A43B 23/30* (2006.01)

(52) U.S. Cl. ..... 36/72 B; 36/72 R; D2/915

(58) Field of Classification Search ..... 36/72 R, 36/72 B, 132, 136; D2/909, 915, 976
See application file for complete search history.

(56) References Cited

U.S. PATENT DOCUMENTS

| | | | | | |
|---|---|---|---|---|---|
| 1,417,934 | A | * | 5/1922 | Miller | 36/72 B |
| 1,820,679 | A | | 8/1931 | Sawyer | |
| 1,828,246 | A | | 10/1931 | Destro | |
| 1,955,159 | A | | 4/1933 | Winget | |
| 2,552,096 | A | | 5/1951 | Johnson | |
| 2,988,830 | A | | 6/1961 | Zacks | |
| 3,025,617 | A | * | 3/1962 | Rizzonelli | 36/72 B |
| 3,217,430 | A | | 11/1965 | Novick | |
| 3,983,641 | A | | 10/1976 | Wright | |
| 4,461,100 | A | * | 7/1984 | Minor et al. | 36/72 B |
| 4,756,097 | A | | 7/1988 | Sanders | |
| D346,060 | S | * | 4/1994 | Martinez | D2/915 |
| 5,357,694 | A | | 10/1994 | Mauck | |
| 5,775,007 | A | | 7/1998 | Expose | |
| D495,854 | S | * | 9/2004 | Francis | D2/915 |

FOREIGN PATENT DOCUMENTS

| | | |
|---|---|---|
| DE | 3235327 | 3/1984 |
| GB | 2118427 | 11/1983 |
| GB | 2217177 | 10/1989 |

* cited by examiner

*Primary Examiner* — Jila Mohandesi
(74) *Attorney, Agent, or Firm* — Christie, Parker & Hale, LLP

(57) ABSTRACT

A heel of a shoe is protected by a protective cover having a tapered sleeve with a wide top end, a narrow bottom end, and an opening in the wide top end for inserting a heel of a shoe, the sleeve formed of a stretchable, protective material. The protective cover includes an attachment tongue extending upward from the top end of the sleeve and attachment tabs extending upward from the top end of the sleeve. The heel of a shoe is inserted into the wide top end of the sleeve, with the attachment tongue and attachment tabs folded over the side and into the interior of the shoe so that a foot inserted into the shoe holds the attachment tongue and attachment tabs in place by frictional engagement between the foot and the interior of the shoe.

25 Claims, 11 Drawing Sheets

HEEL SHEATH PROTECTIVE COVER FOR A SHOE

BACKGROUND OF THE INVENTION

1. Field of the Invention

Figure 1:
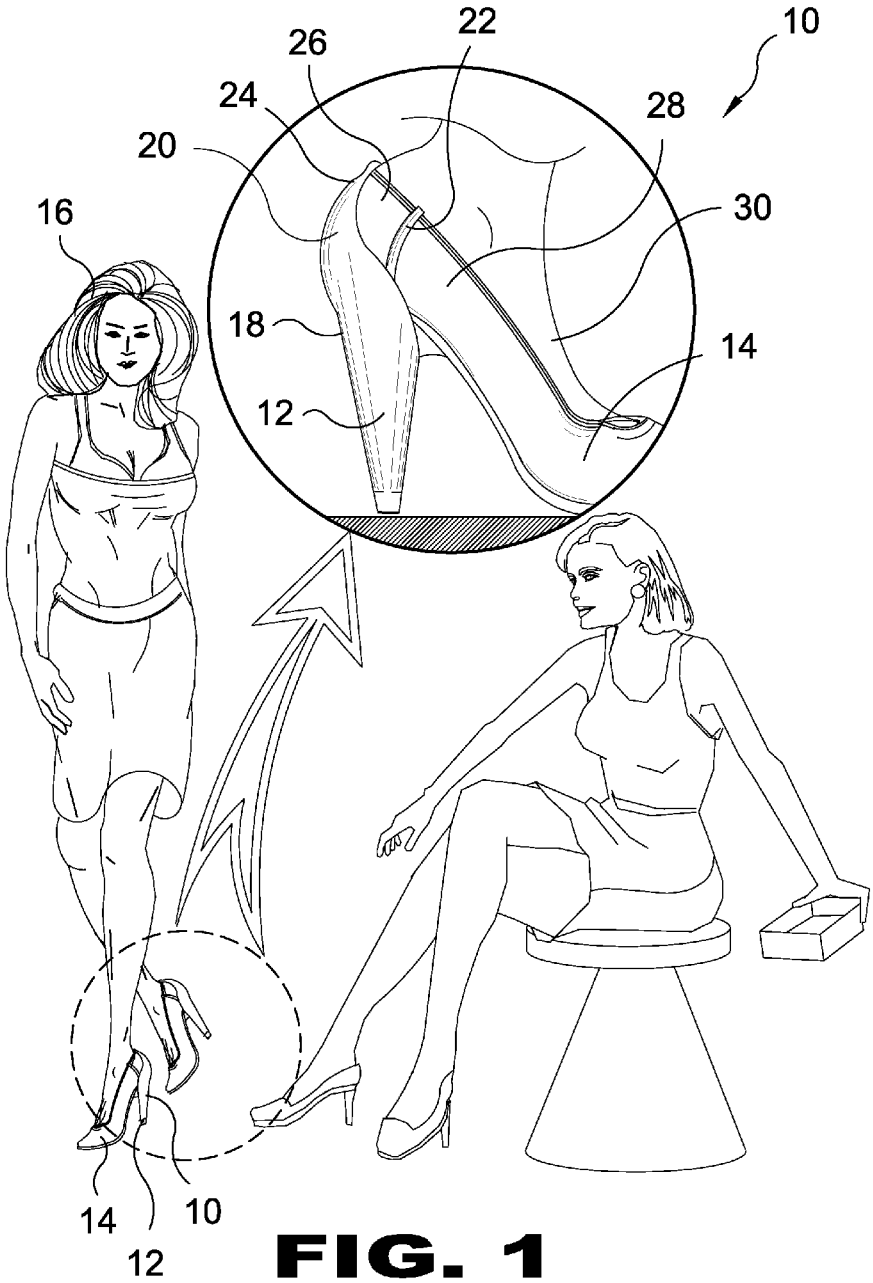

The present invention relates generally to protective coverings and, more specifically, to a guard or protective covering for the heel of a shoe comprising a sheet of flexible protective material having an opening and attachment means. Comprising the main body of the present invention is a triangular or trapezoidal main body composed of stretchable material that has been elasticized in specific regions having a two ply construction with a widened opening presenting a sheath like opening for receiving the shoe's heel, wherein the upper portion of the sheath presents a tongue and attachment tabs for mounting and securing the device to the heel of a shoe. Attachment of the present invention to a heel is maintained by the tongue and attachment tabs forming a frictional bond created between the instep of the shoe and the wearer's foot.

2. Description of the Prior Art

There are other devices designed for protecting a shoe's heel. Typical of these is U.S. Pat. No. 1,820,679 issued to Sawyer on Aug. 25, 1931.

Another patent was issued to Destro on Oct. 20, 1931 as U.S. Pat. No. 1,828,246. Yet another U.S. Pat. No. 1,955,159 was issued to Winget on Apr. 17, 1934 and still yet another was issued on May 8, 1951 to Johnson as U.S. Pat. No. 2,552,096.

Another patent was issued to Zacks on Jun. 20, 1961 as U.S. Pat. No. 2,988,930. Yet another U.S. Pat. No. 3,217,430 was issued to Novick on Nov. 16, 1965. Another was issued to Wright on Oct. 5, 1976 as U.S. Pat. No. 3,983,641 and still yet another was issued on Jul. 12, 1988 to Sanders as U.S. Pat. No. 4,756,097.

Another patent was issued to Mauck on Oct. 25, 1994 as U.S. Pat. No. 5,357,694. Yet another U.S. Pat. No. 5,775,007 was issued to Expose on Jul. 7, 1998. Another was issued to Windsor on Nov. 2, 1983 as British Patent No. GB2118427 and still yet another was issued on Mar. 29, 1984 to Lucoschat as German Patent No. DE3235327. Another was issued to Ismet on Oct. 25, 1989 as British Patent No. GB22117177.

U.S. Pat. No. 1,820,679

Inventor: F. Sawyer

Issued: Aug. 25, 1931

A device of the class described consisting of a body portion adapted to surround the heel and rear portion of a shoe and of the leg of the wearer, a pair of flaps on said body portion adapted to be wrapped around the ankle portion of the leg of a wearer, a strap on said body portion adapter to be arranged under the instep of the wearer, and means for releasable securing the flaps in wrapped position. One said flap having a crosswise extending opening adapted to receive the other flap and said second flap having a pair of openings adapted to alloy the second flap to extend therethrough.

U.S. Pat. No. 1,828,246

Inventor: J. J. Destro

Issued: Oct. 20, 1931

A protector for heels and backs of shoes comprising an elastic member preformed to fit a selected style of heel, said member snugly and completely enclosing the heel and back of the shoe when fitted thereto, the back of said member when placed on the heel terminating flush with the upper portion of the back of the shoe, and an embedded hook adapted to hook over the edge of the rear upper part of the shoe, said hook being in the form of an inverted u shaped member and forwardly thereof to occupy a position between the stocking and the other arm of the U-shaped hook member when the protector is worn, whereby the stocking is protected against damage.

U.S. Pat. No. 1,955,159

Inventor: Nell F. Winget

Issued: Apr. 24, 1933

A guard for shoe heels comprising two pieces of fabric material secured together along their back meeting edge with an outturned seam, and provided with darts along their inner edges formed with outturned seams, adapted to envelope the heel part of a shoe, and a spring steel U-piece at the bottom of said material and secured thereto and adapted to embrace the bottom of the heel and hold the guard position.

U.S. Pat. No. 2,552,096

Inventor: J. Johnson

Issued: May 8, 1951

A heel sheath for use in combination with a conventional shoe having no upper at the rear end, comprising in combination: a cup member of flexible, elongated sheet material, said member, in undistorted condition, being slightly smaller than the heel to which it is being applied; and a mechanical pad underlying the bottom wall of said cup member and affixed thereto; said pad having a flat bottom and vertical sides; the sideward and rearward facing sides of said pad having there lower portions curved inward at a substantial radius to merge tangentially with the flat bottom; the breast of said heel pad having a sharp lower corner; the upper side portions of said cup being extended and joined above the top of the cup; said extensions defining a resilient loop to overlie the heel portion of the sole of the shoe; said loop and cup being of rubber; said pad being of sponge rubber.

U.S. Pat. No. 2,988,830

Inventor: F. B. Zacks

Issued: Jun. 20, 1961

A heel protector device for motorists or the like comprising a heel cover member adapted to receive the heel and rear portion of the upper of the shoe, fastening tapes secured to the upper forward side portions of the member and adapted to be tied over the instep of the wearer, the heel cover member comprising a rearwardly disposed relatively stiff fabric panel extending forwardly on each side of the member about half the extent of the heel, the remainder of the side portions and the front portion of the member comprising a panel of elastic webbing material.

U.S. Pat. No. 3,217,430

Inventor: J. Novick

Issued: Nov. 16, 1965

A heel protector for a heel having a breast portion comprising, in combination, a top portion having a shape adapted to hug part of the counter of the wearer's shoe, a bottom portion partly contiguous with said top portion and having a shape adapted to hug part of said heel of the shoe, and elastic strap means connected to said top and bottom portions at lateral regions of their contact and adapted to hug said breast portion, said strap means being the sole expedient by which the heel protector is attached to the shoe, at least one of said top and said bottom portions having peripheral for lending rigidity to the respective portion, so as to hug the shoe in closely adjacent relationship, said hem portion at least partly consisting of a sectioned beading providing a vacuum effect, when the heel protector is fastened to the shoe so as to exclude dirt from the parts of the shoe covered by the heel.

U.S. Pat. No. 3,983,641

Inventor: James Wright

Issued: Oct. 5, 1976

A guard for protecting the rear half of a shoe from scuffing during driving is an open-toed overshoe which includes a base portion lying under the heel and rear portion of the sole of the shoe. A wall upstanding around the periphery of the base and hugging the rear half of the shoe upper includes a pair of tabs which are snap fastened in overlapping relationship over the instep.

U.S. Pat. No. 4,756,097

Inventor: Clarence Sanders

Issued: Jul. 12, 1988

An adjustable ladies shoe heel protector which has a body of thermoplastic material in the shape of the heel portion of a shoe. Adjustment is provided by an overlapping joint having pressure sensitive adhesive that is formed and joined to match the exact configuration of a specific shoe. The height of a given heel is mated by trimming the heel portion to the appropriate length using perforations as a guide. An integral annealed metal tab is bent over the counter of the shoe holding the protector in place while the user is driving a motor vehicle, thereby preventing scuffing of the shoe. The adjustment in size and convenience of attachment overcomes the problem heretofore encountered with heel protectors.

U.S. Pat. No. 5,357,694

Inventor: Joan K. Mauck

Issued: Oct. 25, 1994

A protector for the heel and back portions of a shoe, to be worn while driving or for decorative purposes, which is formed by material having a high coefficient of friction and the capability of producing an elastic force is disclosed herein. The lower portion of the material is formed into a funnel-shaped tube which grips to the shoe heel, while the middle portion of the material protects the shoe heel and back. The upper portion consists of a relatively wide flap which is used to stretch the protector before the flap is folded down over the back edge of the shoe and pressed against the rear inner wall of the shoe. The protector is thereby secured to the shoe by surface traction. A nylon layer bonded to the non-gripping surface of the protector increases its durability. A method for installing such a protector is also disclosed.

U.S. Pat. No. 5,775,007

Inventor: Darell Expose

Issued: Jul. 7, 1998

A protective device for the heel and back portion of a footwear article including a cover member, at least two user adjustable straps for securing the cover member to a footwear article, and a sealable pouch attached to the cover member. The cover member has a curved exterior surface portion and includes a padded, recessed area for receiving at least a portion of the heel and back of a footwear article and a elongated heel slot formed through a bottom section of the cover member having a width sufficient to allow a standard high heel to be inserted laterally into the slot in a manner such that the back of the shoe to which the highs heel is attached is disposed within the padded recessed area. The sealable pouch is constructed of flexible plastic and has a central portion permanently affixed to the curved exterior surface portion of the cover member device and two side portions that are detachably securable to the curved exterior surface of the cover member with a restickable adhesive. Attaching the sealable pouch permanently at its center and with a restickable adhesive along its two sides allows the opening of the sealable pouch to be easily opened for inserting and removing a treated polishing cloth that is stored within the sealable pouch for use in touching up and polishing small scuffs and other minor damage to the footwear article. The treated polishing cloth is preferably provided with the protective device.

U.K. Patent Number GB2118427

Inventor: Hilda May Windsor

Issued: Nov. 2, 1983

A protective cover for heels of shoes comprises a cover body formed of flexible sheet material having a sleeve or tubular portion locatable over the heel of the shoe and opening out in its upper region into a non-tubular portion which is engageable around the rear end of the shoe upper to protect such whilst in the driving position. Retention means is provided to secure the upper end of the portion sheet around the shoe upper in the heel region.

German Patent Number DE3235327

Inventor: Ina-Katrina Lucoschat

Issued: Mar. 29, 1984

A device is described, for pulling on over the shoe of a woman or a man, which consists of elastic flexible material with side walls adapted externally to the shoe and a bottom. In order that, with such a device, it is still possible easily to protect the actual shoe without having to take it off and without the difficult pulling over of the heel and of the shoe back of known pull-over shoes, it is envisaged according to the invention that, for the formation of a heel protector, the side walls are designed to engage around only the shoe back and the bottom to engage around only the heel of the shoe, the side walls are cut off in the region in front of the shoe back and are open forwards and upwards, and that a closure band is provided to connect one side wall with the other, running transversely across the foot.

U.K. Patent Number GB2217177

Inventor: Ismet Chetin

Issued: Oct. 25, 1989

A cover for a shoe heel, particularly a ladies high heel, comprises a cover adapted to fit around at least part of the shank of the heel. In one embodiment, the cover is a stretch fit and may have an upward extension for covering at least part of the outer surface of the heel end of the shoe. A clip may be provided to engage the upper edge of the shoe. The cover may be adhered to the shoe or may have securing means which passes about the ankle of the wearer or the heel.

While these heel covers may be suitable for the purposes for which they were designed, they would not be as suitable for the purposes of the present invention, as hereinafter described.

SUMMARY OF THE PRESENT INVENTION

A primary object of the present invention is to provide a covering or guard for the heels of shoes formed of a stretchable flexible material that provides a pocket or sheath to encapsulate said heel of the shoe to protect against the elements and/or abrasion.

Another object of the present invention is to provide a covering or guard for the heels of shoes having a tongue and attachment tabs that are utilized to hold the present invention in place by placement into the instep and under the sole of the user's foot.

Yet another object of the present invention is to provide a covering or guard for the heels of shoes having elasticized regions in order to be easily placed onto and over any type of heeled shoe.

Still yet another object of the present invention is to provide a covering or guard for the heels of shoes having an enlarged open portion for receiving the heel of a shoe therein.

Another object of the present invention is to provide a covering or guard for the heels of shoes having a stretchable construction so as to fit and cover substantially most shoe heels.

Additional objects of the present invention will appear as the description proceeds.

The present invention overcomes the shortcomings of the prior art by providing a cover or guard for the heels of a shoe whereby a sheath composed of flexible stretchable material having an enlarged elasticized opening is utilized for encapsulating and surrounding the heel of a shoe, to effectively protect the contained heel from the elements and abrasion. Additionally a tongue and attachment tabs are provided to hold the present invention on a heel by placement of said tongue and attachment tabs into the shoes instep followed by placement of the user's foot and sole into the instep and on top of said tongue and attachment tabs.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

Figure 2:
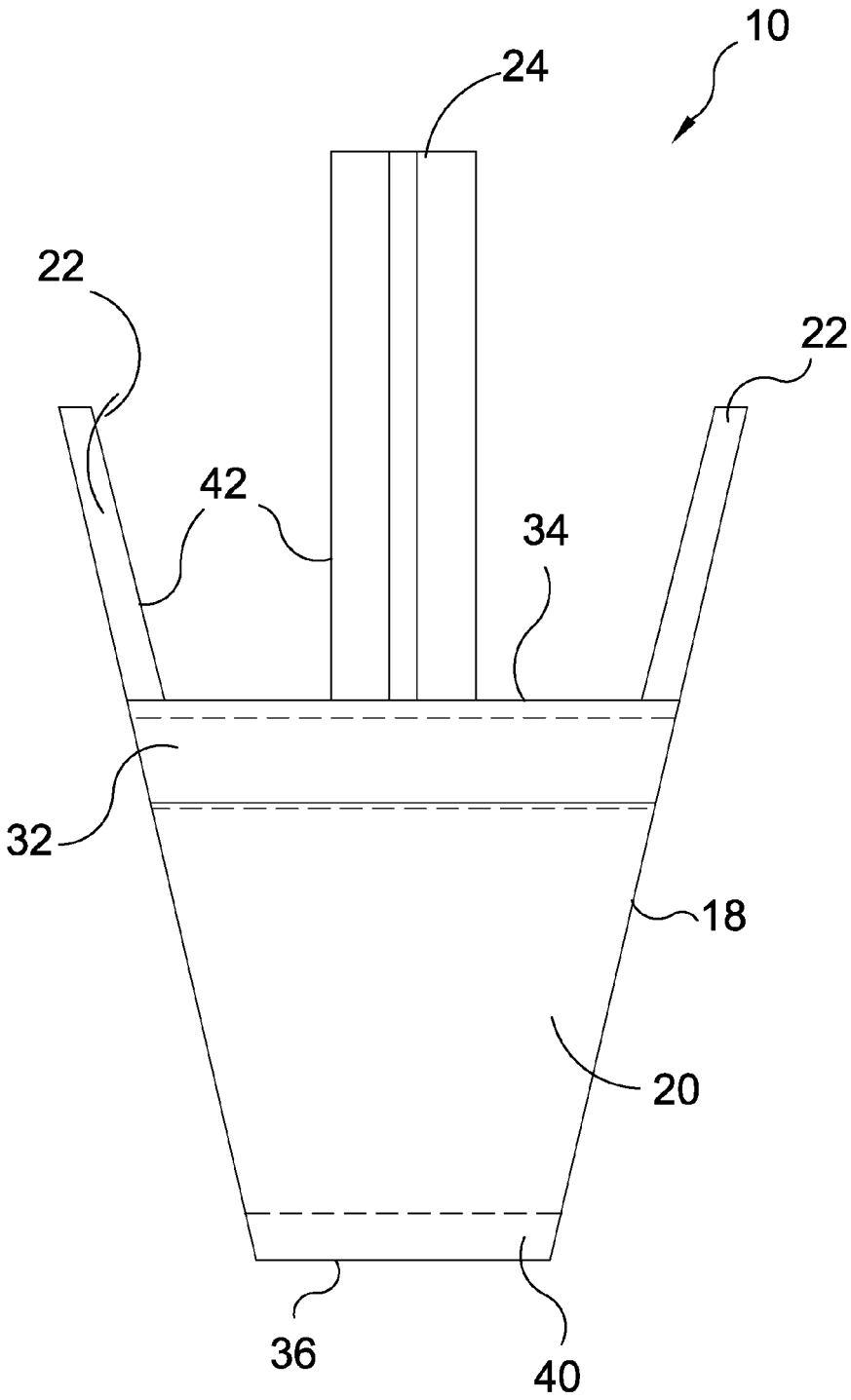
Figure 3:
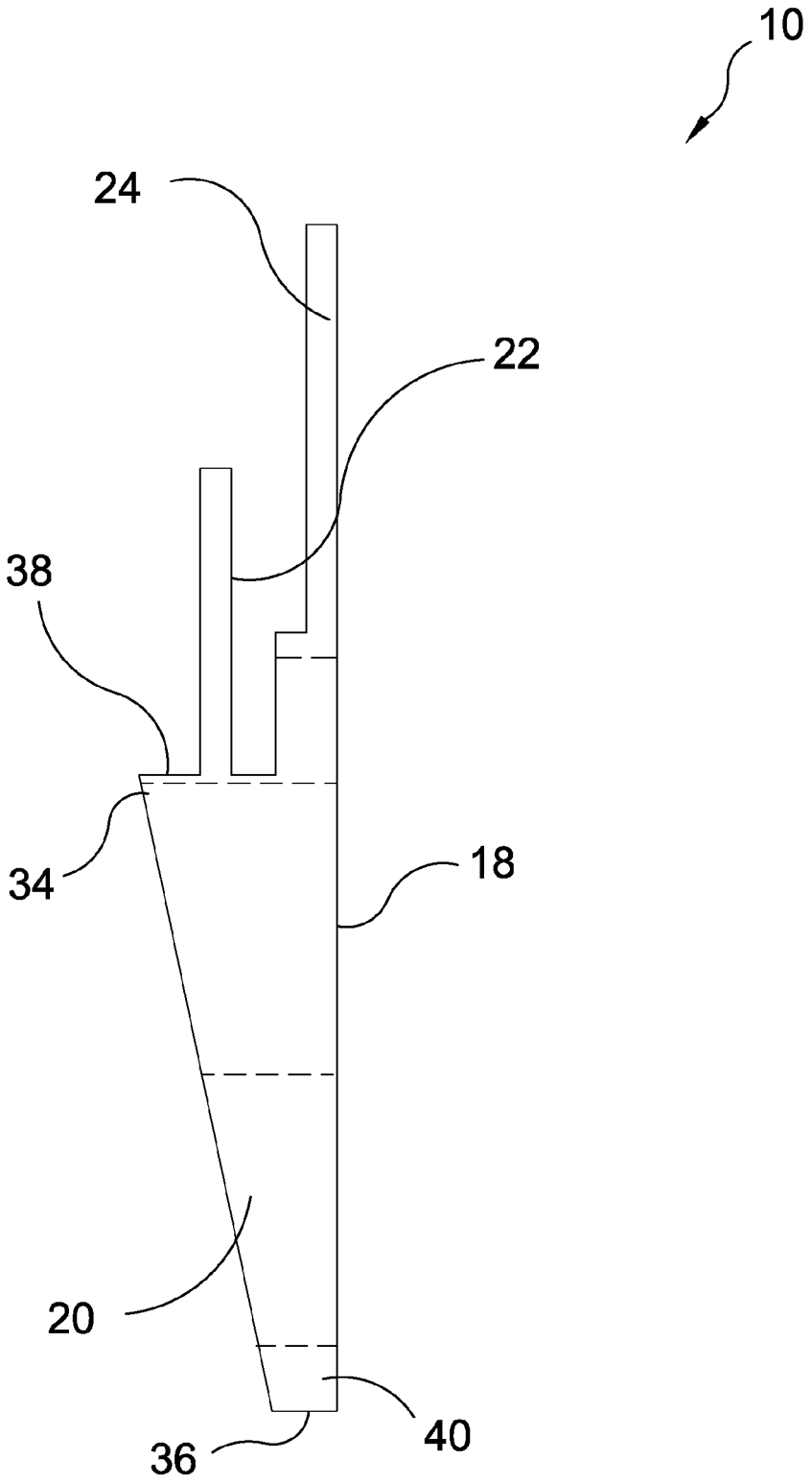
Figure 4:
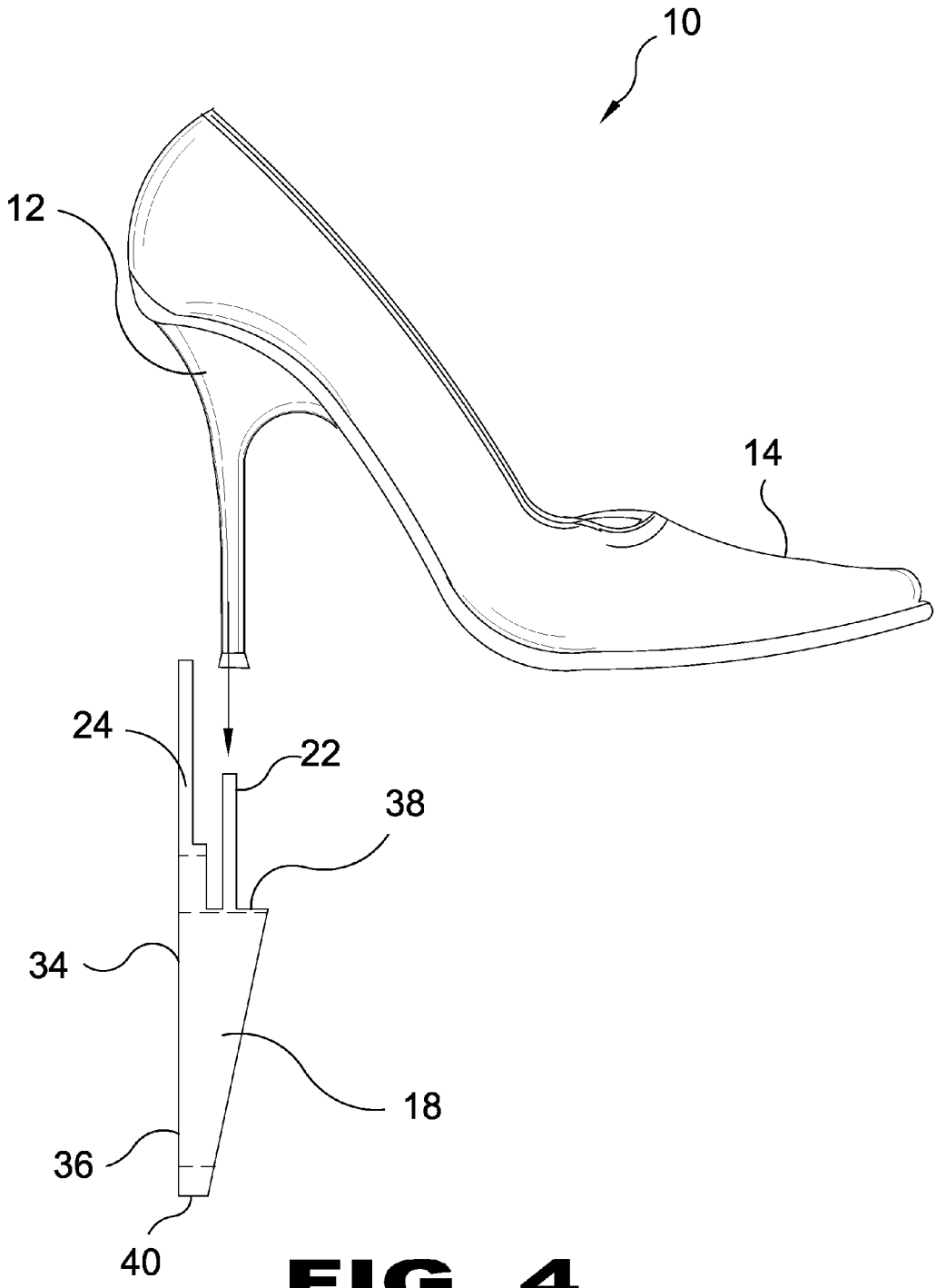
Figure 5:
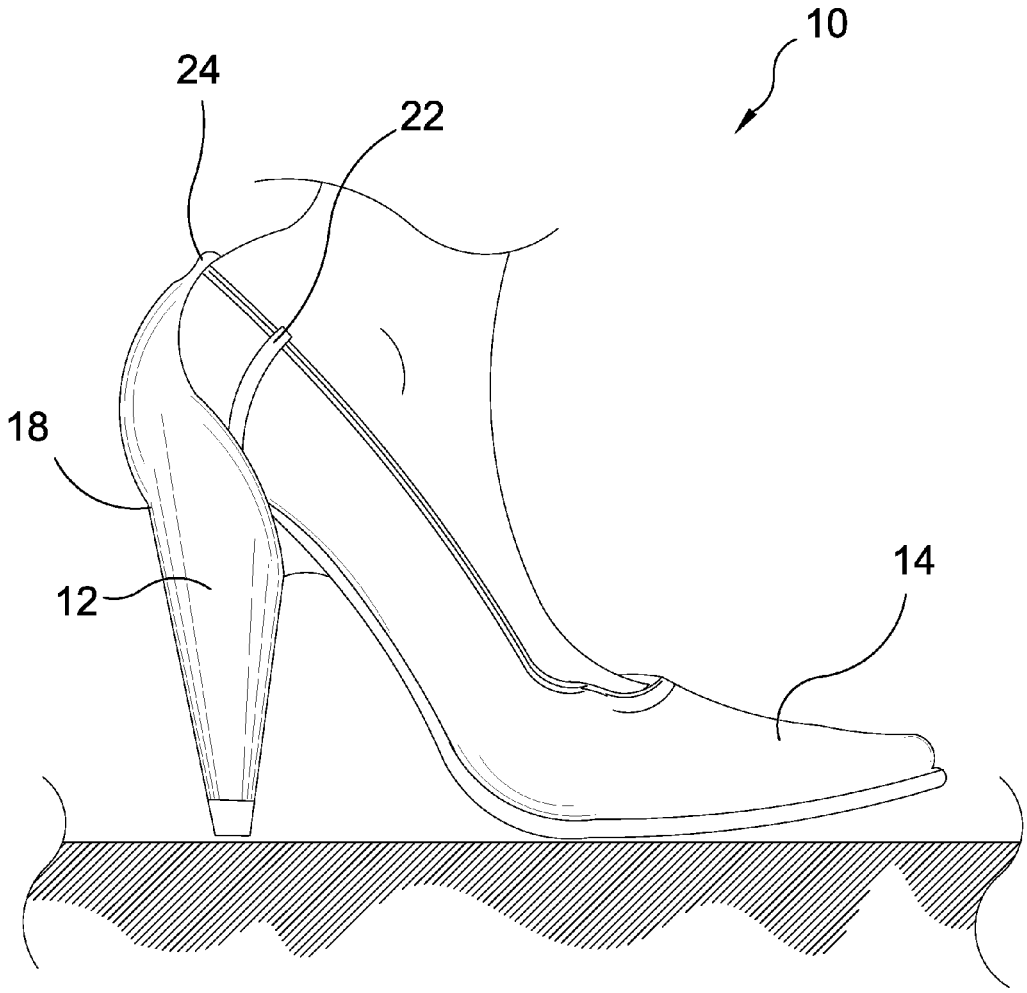
Figure 6:
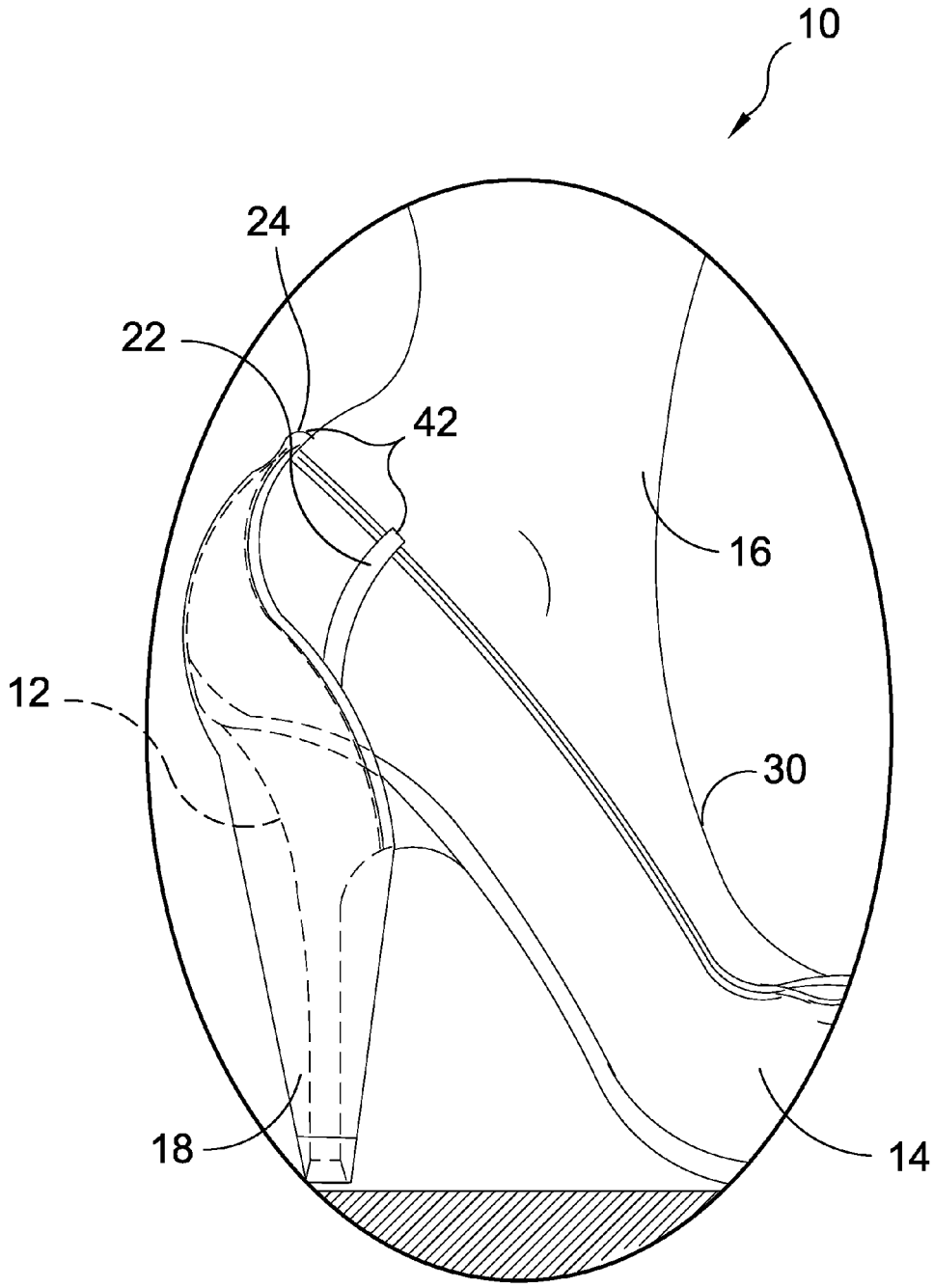
Figure 7:
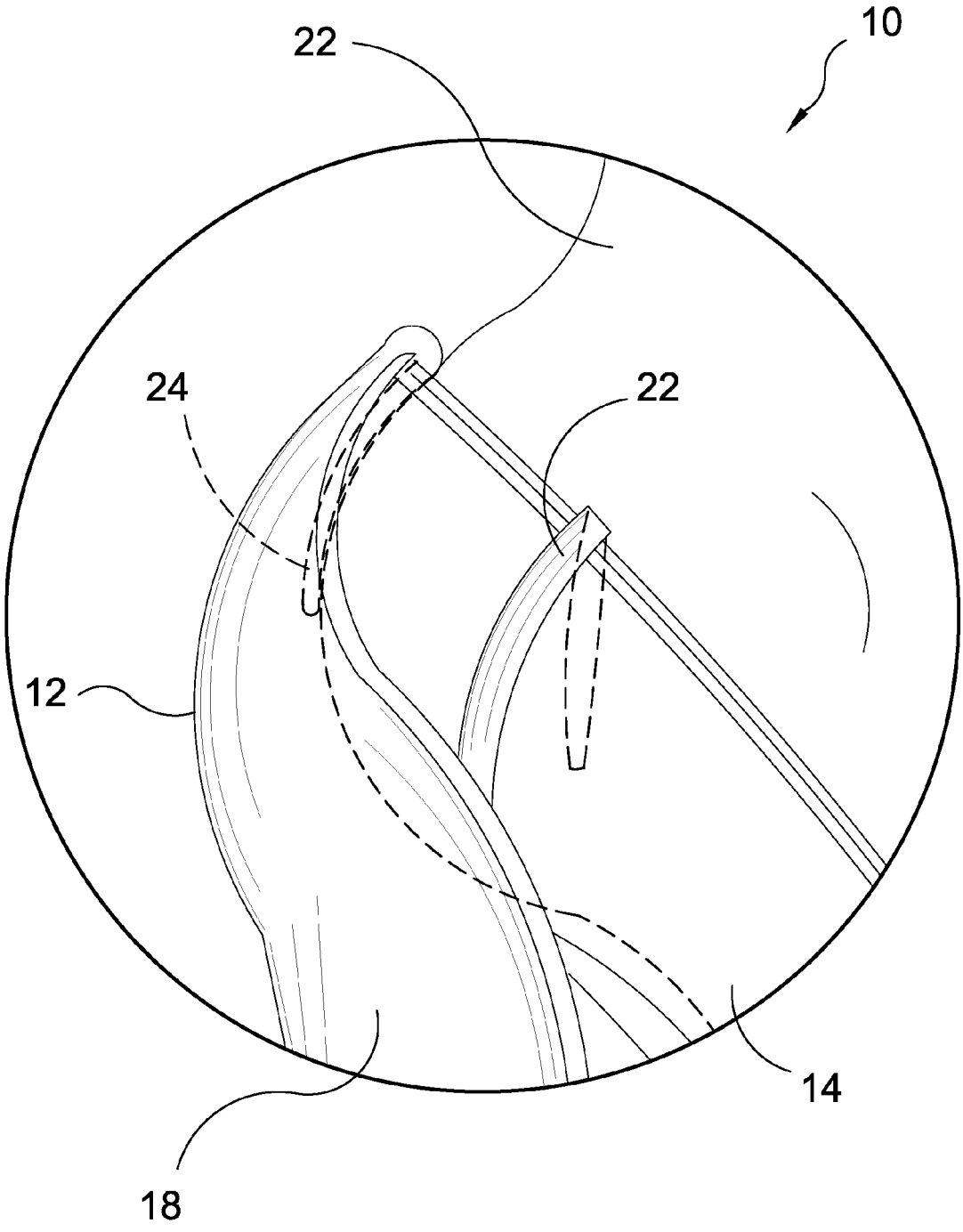
Figure 8:
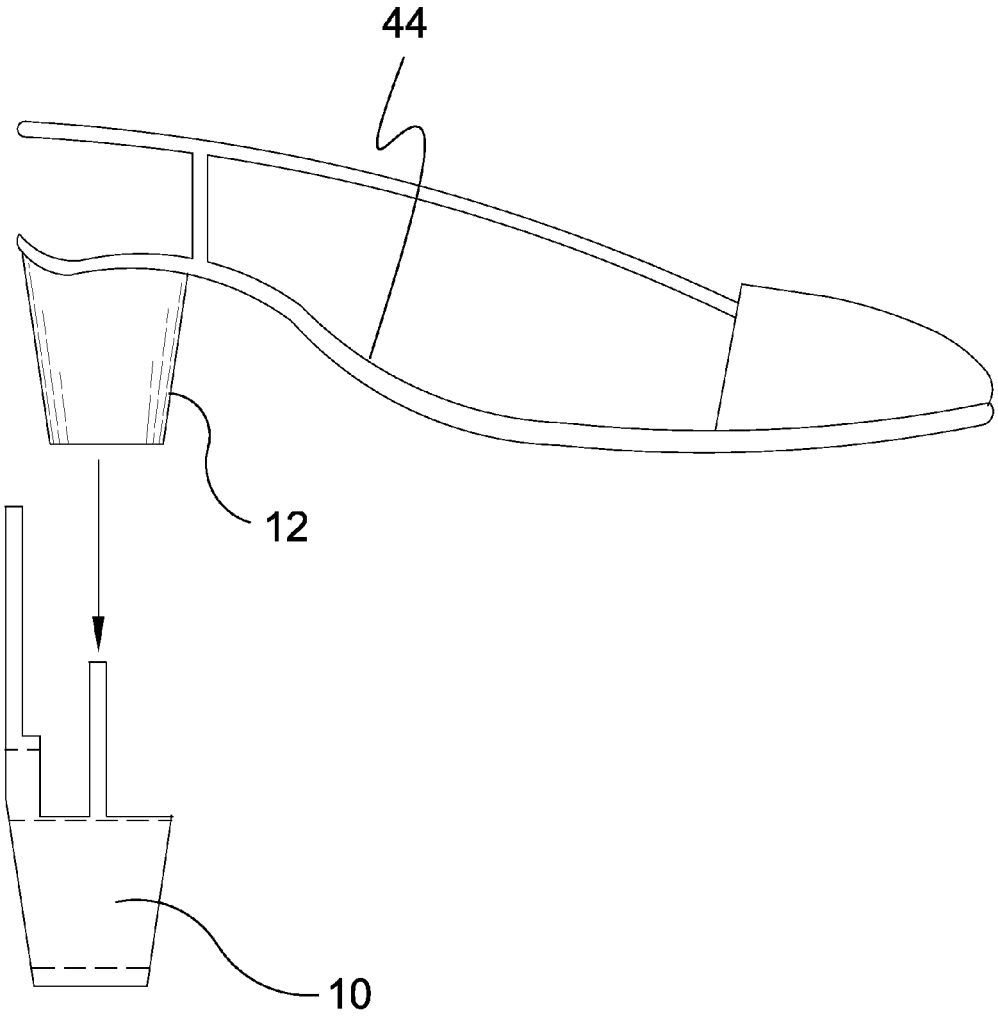
Figure 9:
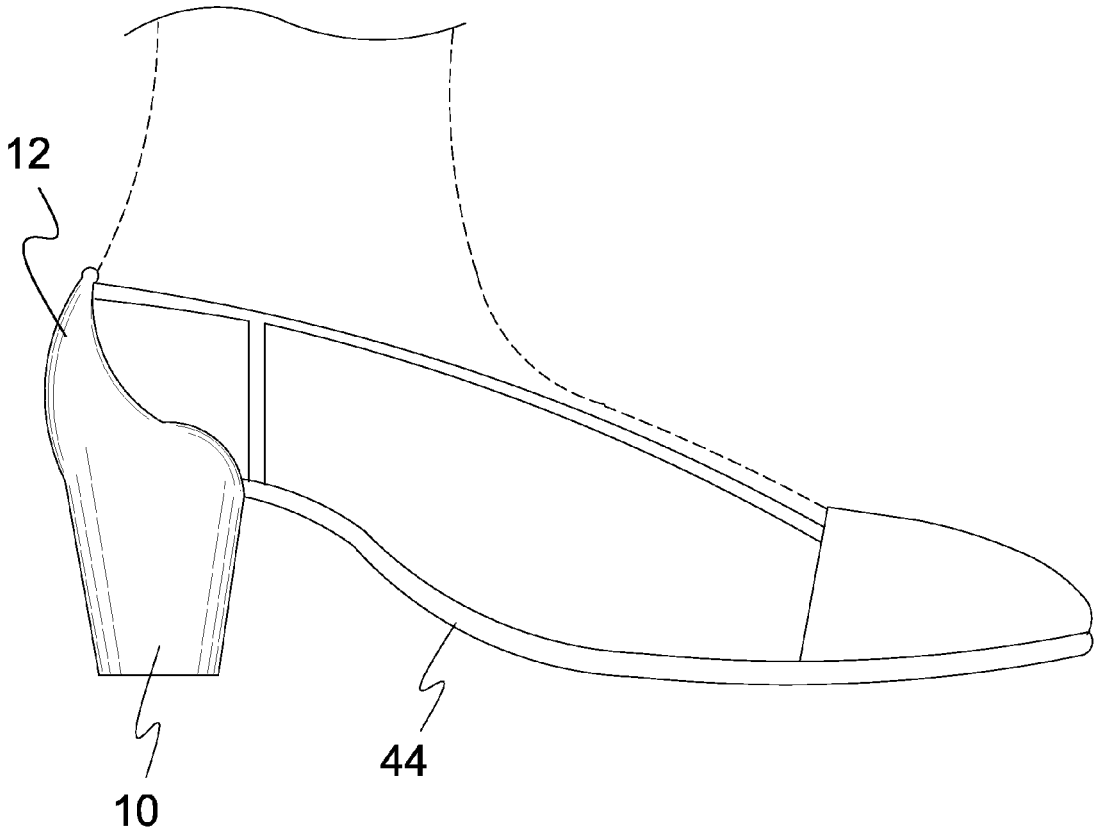
Figure 10:
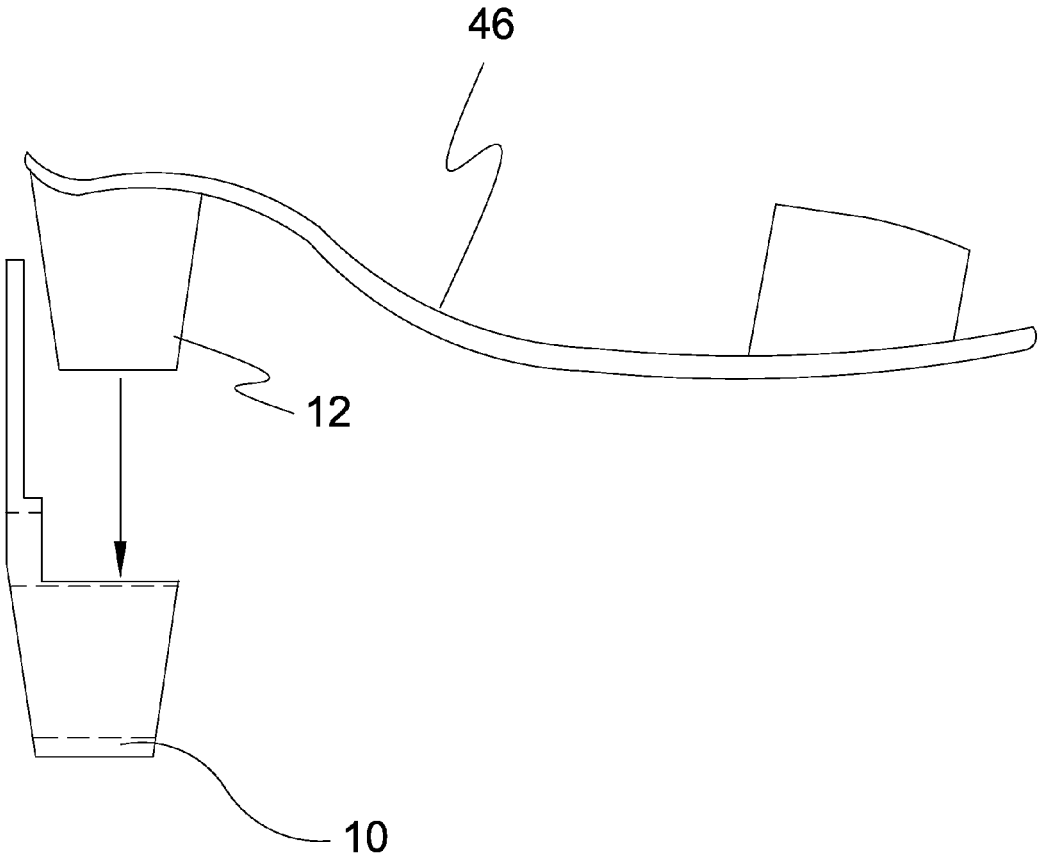
Figure 11:
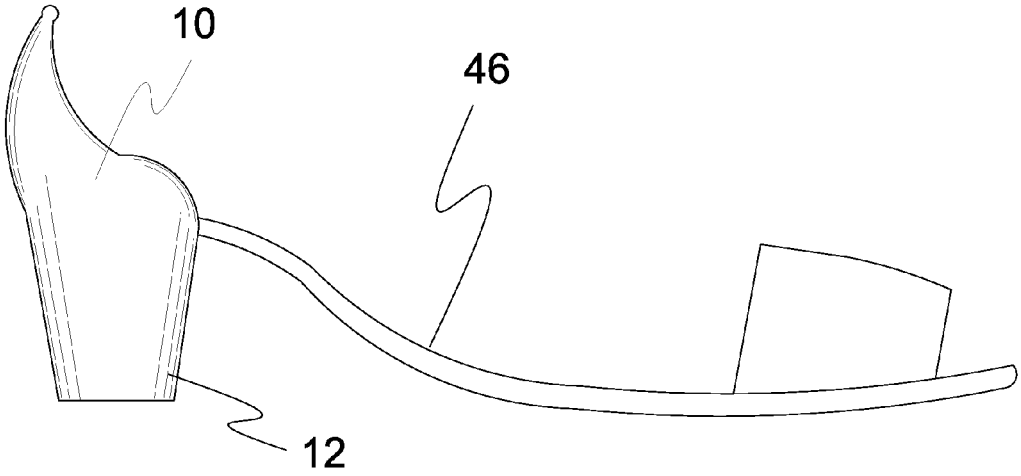

In order that the invention may be more fully understood, it will now be described, by way of example, with reference to the accompanying drawings in which:

FIG. 1 is an illustrative view of the present invention.
FIG. 2 is a front view of the present invention.
FIG. 3 is a side view of the present invention.
FIG. 4 is a side illustrative view of the present invention.
FIG. 5 is an illustrative view of the present invention.
FIG. 6 is a detailed illustrative view of the present invention.
FIG. 7 is an illustrative view of the present invention.
FIG. 8 is a side view of the present invention.
FIG. 9 is a side view of the present invention.
FIG. 10 is a side view of the present invention.
FIG. 11 is a side view of the present invention.

DESCRIPTION OF THE REFERENCED NUMERALS

Turning now descriptively to the drawings, in which similar reference characters denote similar elements throughout the several views, the figures illustrate the Protective Cover for the Heel of a Shoe of the present invention. With regard to the reference numerals used, the following numbering is used throughout the various drawing figures.

10 Protective Cover for the Heel of a Shoe
12 heel
14 shoe
16 user
18 tapered sleeve
20 stretchable, protective material
22 attachment tab
24 attachment tongue
26 back of shoe
28 side portion of shoe
30 foot
32 band of elastic material
34 wide top end of sleeve
36 narrow bottom end of sleeve
38 opening in wide top end of sleeve
40 resilient pad
42 frictional material
44 low heel sling back style shoe
46 low heel open back style shoe

DETAILED DESCRIPTION OF THE PREFERRED EMBODIMENT

The following discussion describes in detail one embodiment of the invention and several variations of that embodiment. This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. Shown is the present invention comprising a protective cover 10 for the heel 12 of a shoe 14. The present invention allows a user 16 to protect a shoe's heel 12 by encapsulating the heel 12 within a tapered sleeve 18 of stretchable, protective material 20 that can be easily worn with most heels by pulling the supplied attachment tabs 22 and attachment tongue 24 over the heel 12 and into the shoe 14. To practice the invention, the heel 12 of a shoe 14 is inserted into the sleeve 18, with the attachment tongue 24 extending upward at a back 26 of the shoe 14 and the attachment tabs 22 extending upward at side 28 portions of the shoe 14. The attachment tongue 24 and attachment tabs 22 are folded into the interior of the shoe 14, and the user's foot 30 is placed into the shoe 14 such that the attachment tongue 24 and attachment tabs 22 are held in place by frictional engagement between the foot 30 and the interior of the shoe 14.

FIG. 2 is a front view of the present invention 10. Shown is a front view of the present invention 10 depicting a plurality of attachment tabs 22 and an attachment tongue 24 for use in keeping the tapered sleeve 18 up and in place around the heel of a shoe. Optionally, a band of elastic material 32 is provided to accommodate shoes with a smaller heel and shape. The protective cover 10 for the heel of a shoe comprises: a tapered sleeve 18 having a wide top end 34, a narrow bottom end 36, and an opening 38 in the top end 34 for inserting a heel of a shoe, with the tapered sleeve 18 formed of a stretchable, protective material 20; an attachment tongue 24 affixed to and extending upward from the top end 34 of the sleeve 18; and a plurality of, preferably two, attachment tabs 22 affixed to and extending upward from the top end 34 of the sleeve 18, the attachment tabs 22 spaced on opposite sides of the attachment tongue 24. The narrow bottom end 36 of the sleeve 18 is closed, and the bottom end 36 of the sleeve 18 can optionally have affixed thereto a resilient pad 40. A preferred embodiment of the invention comprises a band of elastic material 32 spanning the top end 34 of the sleeve 18. In order to maintain the protective cover 10 in position over the heel of a shoe, the attachment tongue 24 and attachment tabs 22 are formed of a frictional material 42 to be held in frictional engagement between the foot of the wearer and the interior of the shoe. The tapered sleeve 18 is shown having a generally trapezoidal profile.

FIG. 3 is a side view of the present invention 10. Shown is the present invention having a trapezoidal profile which provides a widened and elasticized opening for receiving and covering the heel of the shoe placed therein. Attachment tabs 22 and an attachment tongue 24 maintain the tapered sleeve 18 up and in place around the heel of a shoe. The protective cover 10 for the heel of a shoe comprises: a tapered sleeve 18 having a wide top end 34, a narrow bottom end 36, and an opening 38 in the top end 34 for inserting a heel of a shoe, with the tapered sleeve 18 formed of a stretchable, protective material 20; an attachment tongue 24 affixed to and extending upward from the top end 34 of the sleeve 18; and attachment tabs 22 affixed to and extending upward from the top end 34 of the sleeve 18. The narrow bottom end 36 of the sleeve 18 can be closed, and can optionally have affixed thereto a resilient pad 40.

FIG. 4 is a side illustrative view of the present invention 10. Shown is a side view of the present invention 10 in the process of being placed and worn around the heel 12 of a user's shoe 14. The trapezoidal shape accommodates different designs and styles of heels 12. A plurality of attachment tabs 22 and an attachment tongue 24 maintain the tapered sleeve 18 up and in place around the heel 12 of a shoe 14. The protective cover 10 for the heel of a shoe comprises: a tapered sleeve 18 having a wide top end 34, a narrow bottom end 36, and an opening 38 in the top end 34 for inserting a heel 12 of a shoe 14, with the tapered sleeve 18 formed of a stretchable, protective material 20; an attachment tongue 24 affixed to and extending upward from the top end 34 of the sleeve 18; and attachment tabs 22 affixed to and extending upward from the top end 34 of the sleeve 18. The narrow bottom end 36 of the sleeve 18 can be closed, and the bottom end 36 of the sleeve 18 can optionally have affixed thereto a resilient pad 40. The tapered sleeve 18 has a generally triangular or trapezoidal profile.

FIG. 5 is an illustrative view of the present invention. Shown is the present invention fitted over the heel of a high heel shoe 14 comprising an tapered sleeve 18 for conforming to various heel types having an attachment tongue 24 and spaced apart side attachment tabs 22 which fold into the shoe 14. A plurality of attachment tabs 22 and an attachment tongue 24 maintain the tapered sleeve 18 up and in place around the heel 12 of the shoe 14.

FIG. 6 is a detailed illustrative view of the present invention 10. Shown is the tapered sleeve 18 in position over the heel 12 of a shoe 14, the attachment tongue 24 and attachment tabs 22 are formed of a frictional material 42 to be held in frictional engagement between the foot 30 of the wearer 16 and the interior of the shoe 14.

FIG. 7 is an illustrative view of the present invention 10. Shown is the tapered sleeve 18 having a plurality of attachment tabs 22 utilized to form a frictional attachment between the shoe 14 and user's foot 30 while the tapered sleeve 18 covers the heel 12. To practice the invention, the heel 12 is inserted into the sleeve 18, with the attachment tongue 24 extending upward at a back 26 of the shoe 14 and the attachment tabs 22 extending upward at side 28 portions of the shoe 14 and then folded over into the interior of the shoe 14 prior to insertion of the foot 30 therein.

FIG. 8 is a side view of the present invention 10. Shown is a side view of the protective heel cover 10 about to be employed onto the heel 12 a low heel sling back style shoe 44.

FIG. 9 is a side view of the present invention 10. Shown is a side view of a low heel sling back style shoe 44 with the present invention 10 placed and worn around the heel 12 thereof.

FIG. 10 is a side view of the present invention 10. Shown is a side view of the protective heel cover 10 about to be employed onto the heel 12 a low open back style shoe 46.

FIG. 11 is a side view of the present invention 10. Shown is a side view of a low open back style shoe 46 with the present invention 10 placed and worn around the heel 12 thereof. This is depicted to demonstrate the versatility of the present invention 10 and how it may be adapted for employment of many shoe styles and heels of various heights and shapes.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A protective cover for the heel of a shoe comprising:

a) a tapered sleeve having a wide top end, a narrow bottom end, and an opening in said wide top end for inserting a heel of a shoe, said tapered sleeve formed of a stretchable, protective material;

b) an attachment tongue affixed to and extending upward from said top end of said sleeve; and c) a plurality of attachment tabs affixed to and extending upward from said top end of said sleeve, said plurality of attachment tabs spaced on opposite sides of said attachment tongue, wherein each of said plurality of attachment tabs is configured to extend into the shoe.

2. A protective cover for the heel of a shoe according to claim 1, comprising two attachment tabs spaced on opposite sides of said attachment tongue.

3. A protective cover for the heel of a shoe according to claim 1, wherein said narrow bottom end of said sleeve is closed.

4. A protective cover for the heel of a shoe according to claim 1, further comprising a band of elastic material spanning said top end of said sleeve.

5. A protective cover for the heel of a shoe according to claim 1, wherein said attachment tongue and said plurality of attachment tabs are each formed of a frictional material.

6. A protective cover for the heel of a shoe according to claim 3, further comprising a resilient pad affixed to said bottom end of said sleeve.

7. A protective cover for the heel of a shoe according to claim 1, wherein said sleeve comprises regions having a two-ply construction.

8. A protective cover for the heel of a shoe according to claim 1, wherein said sleeve has a generally trapezoidal profile.

9. A protective cover for the heel of a shoe according to claim 1, wherein said sleeve has a generally triangular profile.

10. A protective cover for the heel of a shoe according to claim 2, wherein said narrow bottom end of said sleeve is closed.

11. A protective cover for the heel of a shoe according to claim 10, further comprising a band of elastic material spanning said top end of said sleeve.

12. A protective cover for the heel of a shoe according to claim 11, wherein said attachment tongue and said plurality of attachment tabs are each formed of a frictional material.

13. A protective cover for the heel of a shoe according to claim 12, further comprising a resilient pad affixed to said bottom end of said sleeve.

14. A protective cover for the heel of a shoe according to claim 13, wherein said sleeve comprises regions having a two-ply construction.

15. A protective cover for the heel of a shoe according to claim 13, wherein said sleeve has a generally trapezoidal profile.

16. A protective cover for the heel of a shoe according to claim 13, wherein said sleeve has a generally triangular profile.

17. A method of protecting a heel of a shoe, comprising the steps:

a) providing a protective cover for the heel of a shoe having a tapered sleeve with a wide top end, a narrow bottom end, and an opening in said wide top end for inserting a heel of a shoe, said tapered sleeve formed of a stretchable, protective material, an attachment tongue affixed to and extending upward from said top end of said sleeve, and a plurality of attachment tabs affixed to and extending upward from said top end of said sleeve, said plurality of attachment tabs spaced on opposite sides of said attachment tongue, wherein each of said plurality of attachment tabs is configured to extend into the shoe;

b) inserting a heel of the shoe into said wide top end of said sleeve, with said attachment tongue extending upward at a back of the shoe and said attachment tabs extending upward at the side portions of the shoe;

c) folding said attachment tongue into an interior of the shoe;

d) folding said attachment tabs into an interior of the shoe, and e) inserting a foot into the shoe such that said attachment tongue and said plurality of attachment tabs are held in place by frictional engagement between the foot and the interior of the shoe.

18. A method of protecting a heel of a shoe according to claim 17, wherein said protective cover comprises two attachment tabs spaced on opposite sides of said attachment tongue.

19. A method of protecting a heel of a shoe according to claim 18, wherein said narrow bottom end of said sleeve is closed.

20. A method of protecting a heel of a shoe according to claim 19, wherein said protective cover further comprises a band of elastic material spanning said top end of said sleeve.

21. A method of protecting a heel of a shoe according to claim 20, wherein said attachment tongue and said plurality of attachment tabs are each formed of a frictional material.

22. A method of protecting a heel of a shoe according to claim 21, wherein said protective cover further comprises a resilient pad affixed to said bottom end of said sleeve.

23. A method of protecting a heel of a shoe according to claim 22, wherein said sleeve comprises regions having a two-ply construction.

24. A method of protecting a heel of a shoe according to claim 22, wherein said sleeve has a generally trapezoidal profile.

25. A method of protecting a heel of a shoe according to claim 22, wherein said sleeve has a generally triangular profile.

* * * * *